United States Patent [19]

Takai et al.

[11] Patent Number: 4,586,32(

[45] Date of Patent: May 6, 198(

[54] PACKING APPARATUS

[75] Inventors: Takao Takai; Fumio Okada; Hiroyoshi Odawara; Fukumatsu Mitogawa, all of Onomichi, Japan

[73] Assignees: Furukawa Mfg. Co., Ltd., Tokyo; Furukawa Kogyo Co., Ltd., Hiroshima, both of Japan

[21] Appl. No.: 618,669

[22] Filed: Jun. 8, 1984

[30] Foreign Application Priority Data

Jun. 9, 1983 [JP] Japan ..... 58-103936

[51] Int. Cl.[4] ..... B65B 31/02

[52] U.S. Cl. ..... 53/512; 53/571; 53/373

[58] Field of Search ..... 53/89, 91, 95, 386, 53/432, 434, 468, 512, 571, 373; 137/DIG. 8, 102, 103; 141/46

[56] References Cited

U.S. PATENT DOCUMENTS

| | | | |
|---|---|---|---|
| 2,757,842 | 8/1956 | Gaubert | 53/386 |
| 3,010,264 | 11/1961 | Christensson | 53/95 |
| 3,511,021 | 5/1970 | Lyon et al. | 53/512 |
| 4,308,900 | 1/1982 | Vadas | 53/434 |
| 4,480,657 | 11/1984 | Marshall et al. | 137/10 |

FOREIGN PATENT DOCUMENTS

| | | | |
|---|---|---|---|
| 2556738 | 6/1976 | Fed. Rep. of Germany | 173/DIG. |

*Primary Examiner*—John Sipos
*Assistant Examiner*—Donald R. Studebaker
*Attorney, Agent, or Firm*—Stevens, Davis, Miller & Mosher

[57] ABSTRACT

A rotary packing apparatus wherein a plurality of bag support elements support a flexible bag in suspension The support elements are moved intermittently alon an endless circular path, and the bags are fed to th bag-support elements on the path. Thereafter, object are placed in the bags at a given position on the pat The filled bag is then subjected to a vacuum and sealec Two vacuum chambers are provided between the posi tion at which objects are placed in the bags and th position for sealing the bags, such that the bags ar subjected to a vacuum at each of the two vacuum cham ber stages, and are exposed to atmospheric pressur between these two stages.

5 Claims, 10 Drawing Figures

PACKING APPARATUS

FIELD OF THE INVENTION

This invention relates to a rotary system vacuum packing apparatus, wherein a flexible bag made of, for example, a thermoplastic synthetic resin film is supported in suspension by a bag-support element to be conveyed along a circular endless path, an object such as a food stuff is filled into the bag upon its travelling along the endless path, a vacuum is applied to the inside of the bag placed within a chamber provided in the endless path, and an opening portion of the bag is sealed.

BACKGROUND OF THE INVENTION

In the United States of America juicy objects, such as pickles, are usually packed by use mainly of bottles or cans. Some business men in the field concerned are eager to employ a bag for packing such kind of objects because bags are cheaper to produce than bottles and cans. But, when the bag is filled with objects, especially a liquid, and seated, the bag is unstable in comparison with the bottles and cans and cannot be seated well, so that bags are not fit for use in packing by the automatic packing device. Therefore, bottles and cans are widely employed at present.

U.S. Pat. Nos. 3,982,376 and 4,081,942 disclose a rotary system packing apparatus wherein bags kept in suspension by a mechanical clamp are conveyed in order to be filled with objects by a filling unit provided at a predetermined position, and thereafter, an opening portion of the bag is sealed at the next stage. The inventor has given notice that a vacuum chamber is incorporated into such conventional apparatus, and each mechanical clamp is moved integrally with the vacuum chamber, so that the juicy objects with a liquid may be vacuum packed mechanically by use of even bags of poor stability in setting as aforesaid. But, a simple technical conception merely given to the apparatus only produces a bad economy and leads to various problems. An imaginative possible construction of such type of vacuum-packing apparatus may comprise a section for feeding a bag to the clamp, a section for opening the mouth of the bags and fitting therein a liquid and objects, a section for applying a vacuum inside the bags, a section for sealing the opening portion thereof, and a section for removing the sealed bags from the clamps. The vacuum chambers must be open at all sections other than the section for applying the vacuum inside the bag and the section for sealing the opening portions of the bags. In other words, it is natural that the vacuum chambers do not at all function or work at the sections where the chambers are open, so that such sections do not need any vacuum chamber. Furthermore, in case the bags are employed for packing the objects together with a liquid, it is necessary to give special attention to the following points.

(1) When chopped objects like pickles chopped by a knife are filled, together with a liquid, into a bag which is then subjected to a vacuum, numerous bubbles rise up in the liquid toward the mouth of the bag corresponding to a drop of pressure. Some bubbles are caught by the chopped objects to be kept thereunder. The bags are often sealed with such bubbles being kept inside the bag. In case the bag is transparent, the kept bubbles are visible, so that such products are not preferable ones and deviate from a standard vacuum-packed product.

(2) A thin flexible bag is apt to be twisted or bent when it is fed to the clamp, so that when each of such bags is continuously caught by mechanical clamps, failure of catching of such bags often happens.

SUMMARY OF THE INVENTION

The invention has been designed to overcome the above problems. An object of the invention is to provide a rotary system vacuum-packing apparatus wherein the bagss for containing the objects are continuously fed to an element for supporting the bags in suspension. The element supporting the bags rotates along an endless path to then allow the bags to be filled with the objects. An optimal least number of necessary vacuum chambers are provided as a packing device for sealing the opening portion of the bag, thereby providing an economical and improved vacuum-packing apparatus. Another object of the invention is to provide an improved vacuum-packing apparatus wherein any bubbles inside the bags are completely expelled by use of a reduced number of vacuum chambers. A further object of the invention is to provide an improved vacuum-packing apparatus wherein the above-described failure of catching of the bags is eliminated and any problems related to the catching and other features are reduced.

The invention relates to a rotary system packing apparatus which is constituted to allow a flexible bag with an opening to be supported in suspension with the opening kept above, and comprises a plurality of bag-support elements peripherally arranged at a constant interval, a conveying means for intermittently transporting the bag-support elements along a circular endless path at the same pitch as that of the arrangement of each of the bag-support elements, a bag-feed means for feeding the bags to the bag-support elements intermittently moved by the conveying means, a filling means for filling objects into the bags through their opening portions, the bags being supported by the bag-support elements, a sealing means for sealing the opening portions of the bags, and a vacuum pump.

A first and a second vacuum chamber communicate with the vacuum pump and create a vacuum in the bags. The chambers are arranged at two points, where the bag-support elements rest temporarily, between the filling means for the objects and the sealing means. The bags supported by the bag-support means are subjected to a vacuum inside the first vacuum chamber provided first in the direction of conveying the bag-support elements, and thereafter, the first vacuum chamber is open to atmosphere, then the bags are again subjected to a vacuum inside the second vacuum chamber provided secondly behind the first vacuum chamber.

Each bag-support element comprises a pair of suction blocks having suction bores communicating with the vacuum pump, so that the bag can be attracted by the suction blocks and supported in suspension. At least one of the suction blocks is provided with a plurality of sparsely-mounted elastic friction materials, and one of the suction blocks is subjected to a spring force so as to elastically hold the bag through the suction blocks. Furthermore, automatic shut-off valves are provided for each vacuum passage connecting the vacuum pump with the suction blocks and immediately close the passages corresponding to a change of differential pressure when air leakage occurs at any of the passages.

According to the invention, the bag supported by the ıag-support elements are conveyed into the two vacıum chambers set at the first and second points in the lirection of conveying the bag-support elements, i.e., ıetween the objects-filling position and the sealing posiion, so that the bags can be subjected to two stages of 'acuum, i.e., a primary vacuum and a secondary vacıum. Additionally, when the bags move from the first 'acuum chamber to the second vacuum chamber, the ıag is given an impact of introduction of atmospheric ıressure due to the open of the first vacuum chamber, o that the bubbles caught under the objects inside the ıag can be moved and taken out together with any ıther residual bubbles. The second vacuum chamber gain applies vacuum to the bag to thereby more comıletely expel the residual bubbles. As seen from the bove, although the number of vacuum chambers is mall, the bubbles in the bags are completely expelled to ırovide a vacuum-packed product keeping no bubbles herein, so that a least number of necessary vacuum hambers are employed without unnecessary vacuum hambers, resulting in an economical production of the pparatus.

Furthermore, the bag-support elements comprise uction blocks, and elastic friction materials for preventıg the bag from sliding down, and the bags are pressed y a spring force to be supported by the friction materils and the suction block, so that even when a differenial pressure vanishes inside the vacuum chamber, the uction bars surely support the bag without its moving own.

Additionally, each automatic shut-off valve provided t the passages connecting the vacuum pump with each uction block, when air leakage occurs in any of the assages, closes only the passage concerned to thereby ıevent air from flowing into other passages. Hence, he problem at the passages in turn, suction blocks can e minimized but not affect other suction bars. Due to uch features for remedy agaist these problems, the unction bars having a decreased risk of failure of catchıg the bags in comparison with the mechanical clamps an be used, and a vacuum-packing apparatus having ewer problems can be provided.

These and other objects and characteristics of the ıvention will be made more apparent by the following pecification according to the attached drawings. The ame elements shown in the respective drawings have he same reference numerals.

DETAILED DESCRIPTION OF THE INVENTION

Figure 1:
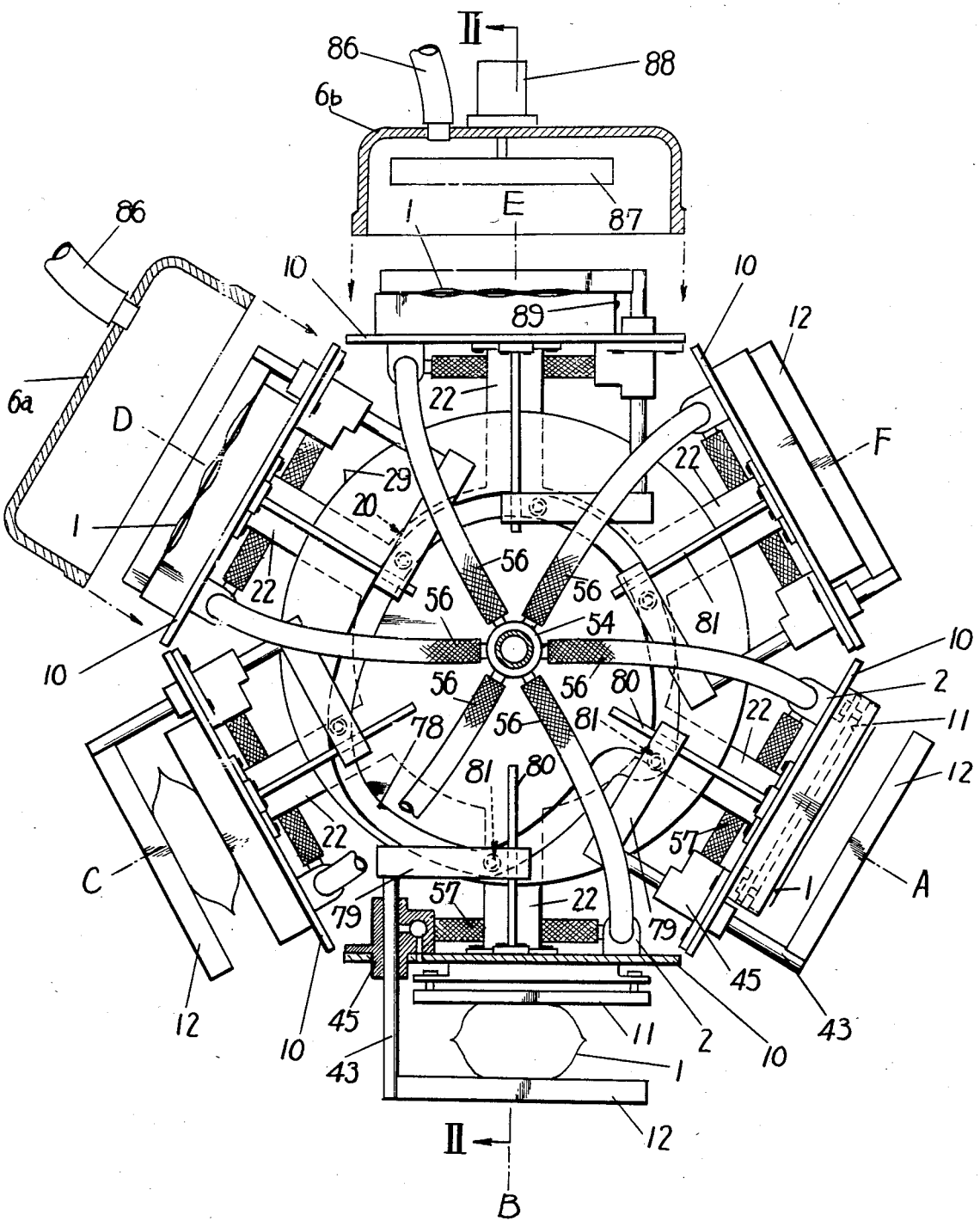
FIG. 1 is a plan view of an embodiment of a rotary ystem vacuum-packing apparatus of the invention.

The rotary system vacuum packing apparatus of the invention as shown in FIG. 1 comprises six plates 10 arranged hexagonally around the central shaft, and bag-support elements, i.e., suction blocks 11, 12 formed at each plate 10 for attracting the bags 1. Each plate 10 is arranged to intermittently rotate to stop at every pitch around the central shaft, and a chamber member *6a*, *6b* is provided to be opposite to each plate 10 at their stoppage position, so that the chamber member *6a*, *6b* together with the plates 10 form an air-tight chamber wherein the objects contained in the bag are subjected to the vacuum.

Figure 2:
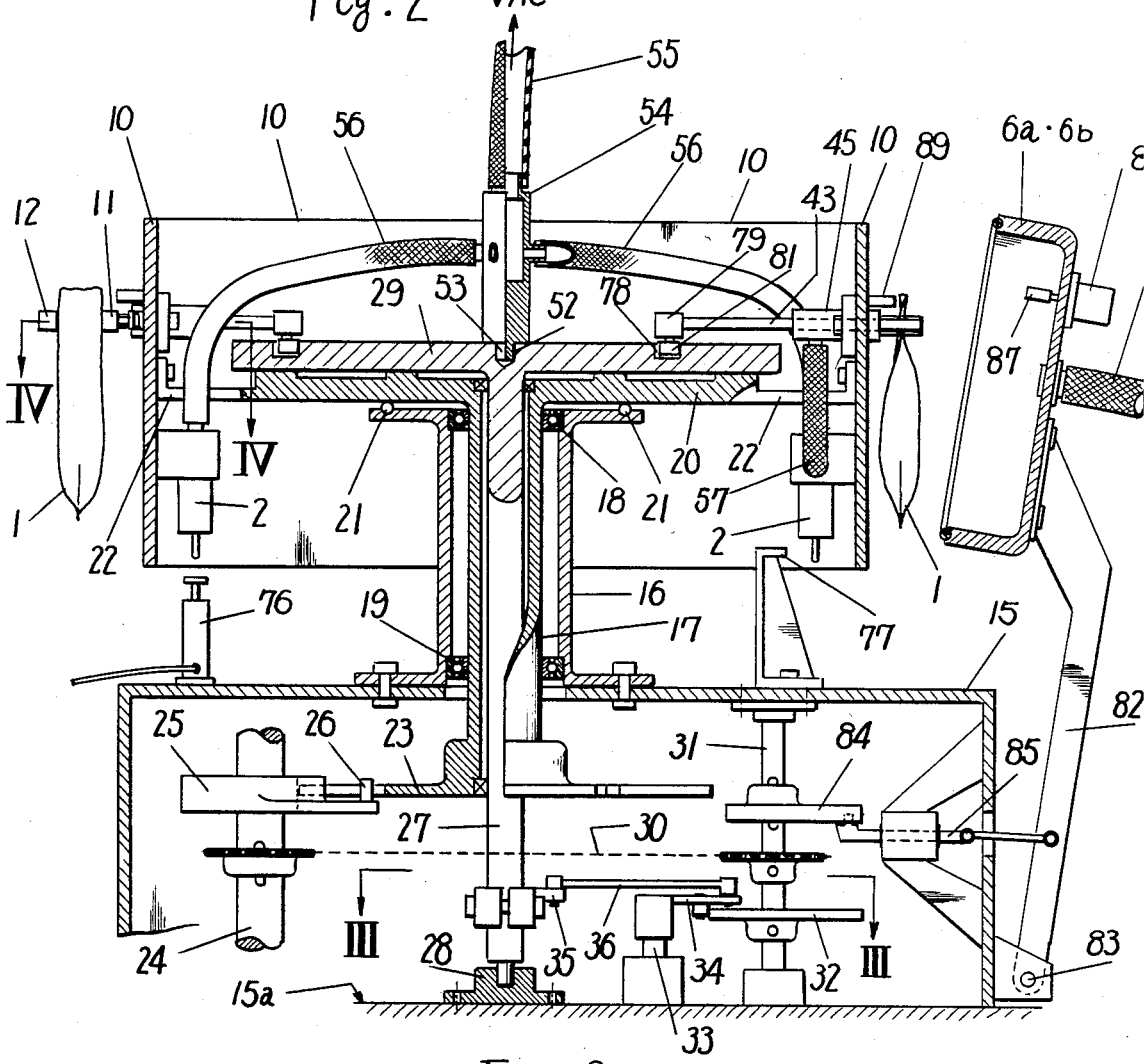
FIG. 2 is a sectional view taken on the line II—II in 'IG. 1.

As shown in FIG. 2, the vacuum packing apparatus comprises a box-like shaped base 15 onto which a tubular bearing cylinder 16 is centrally longitudinaly fixed. A tubular main shaft 17 is supported to the bearing cylinder 16 through ball bearings 18, 19. The main shaft 17 is formed at its upper end with a disk-like rotor 20 extending in continuation therewith, the rotor 20 being supported to the upper surface of the bearing cylinder 16 through thrust bearing 21. The six plates 10 are vertically fixed to the utmost ends of six arms 22 which extend radially at the peripheral surface of the rotor 20.

Figure 3:
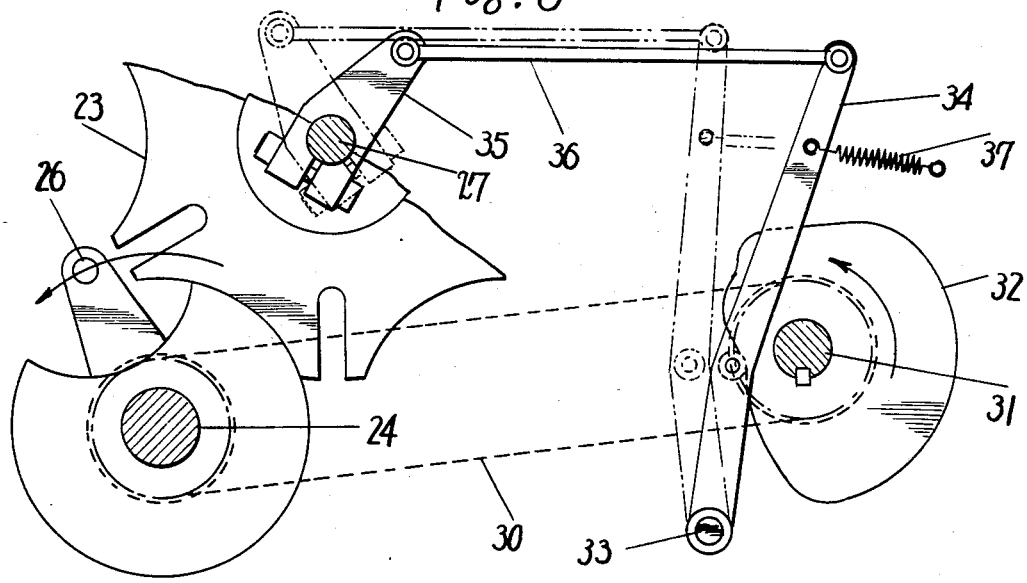
FIG. 3 is a sectional view taken on the line III—III in 'IG. 2.

At the lower end of the main shaft 17 is fixed a Geneva gear 23 which has six radial grooves at regular angular intervals and serves as a part of an element intermittently conveying the bag-support elements. At a part of wheel 25 fixed onto a driving shaft 24 is provided a pin 26 engageable with the Geneva gear 23, so that when the driving shaft 24 is rotated by a driving source (not shown), such as an electric motor or prime mover, the pin 26 revolves around the driving shaft 24 and periodically engages with the Geneva gear 23 to rotate the main shaft 17 intermittently, thereby enabling the six plates 10 to rotate intermittently at every pitch of angle of 60 degrees. Furthermore, an axle 27 is rotatably provided within the main shaft 17 to be supported at the lower end to a bearing 28 which is fixed to the bottom face *15a* of the base. The axle 27 has at the upper end a grooved cam plate 29 extending in continuation therewith. While a cam 32 is fixed to a driven shaft 31 which is connected with the driving shaft 24 through a chain 30. A bell crank 34 is pivoted to a pin 33 which is provided on the bottom of base at a predetermined interval with respect to the driven shaft 31 as shown in FIG. 3. The bell crank 34 makes contact with the cam 32 by the aid of the tension of spring 37. The bell crank 34 is connected, through a link 36, with a lever 35 fixed at a lower end of the main shaft 17, so that swinging movement of the bell crank 34 is transmitted thereto through the link 36 and lever 35 to thereby allow the grooved cam plate 29 fixed on the upper end of the main shaft to repeatedly turn over at the range of angle of about 60 degrees.

Figure 4:
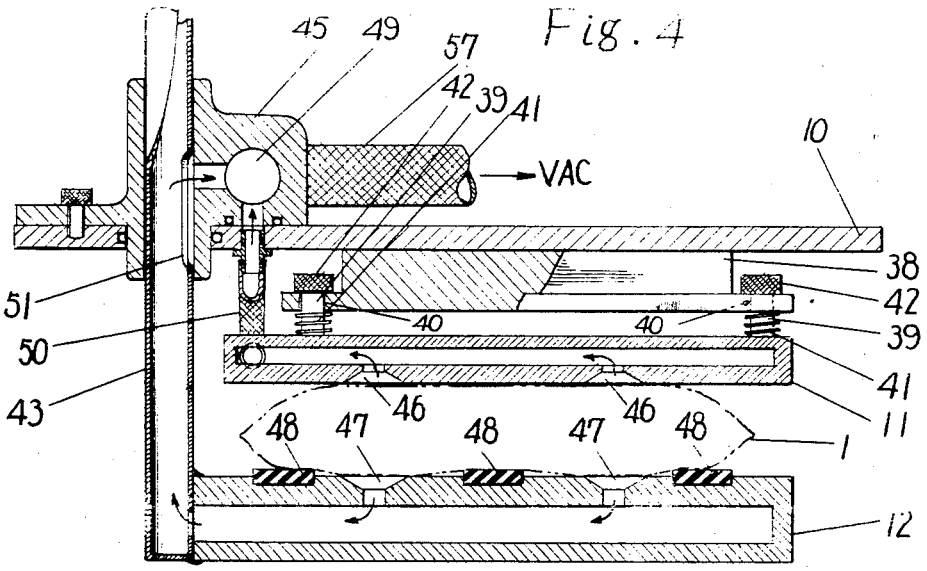
FIG. 4 is a sectional view taken on the line IV—IV in 'IG. 2.
Figure 5:
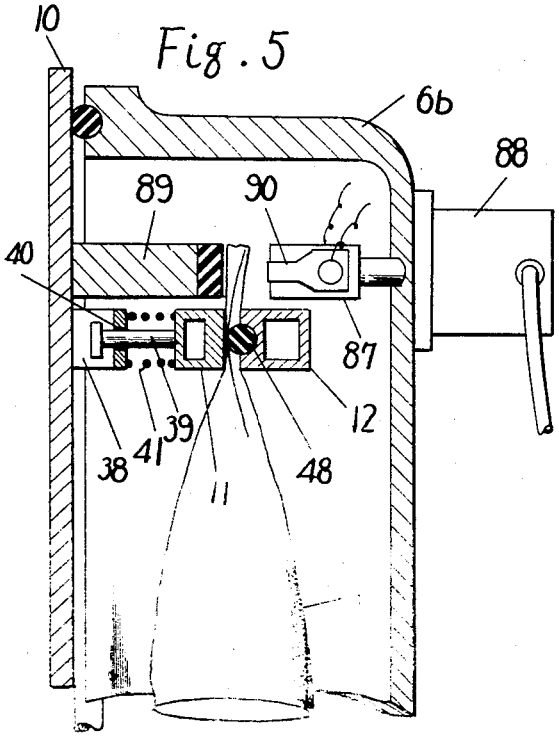
FIG. 5 is a longitudinal partially sectional view of a acuum chamber

As aforesaid, each plate 10 has a pair of suction blocks 11, 12. Specific construction thereof is as shown in FIGS. 4 and 5. The plate 10 has at the front upper part a base plate 38 having two holes 40. A fixed suction block 11 is provided at the back with two fixed pins 39 which are slidably supported to the holes 40 at the base plate. Tension springs 41 are fitted onto each pin 39 between the fixed suction block 11 and the base plate 38, so that the tension of springs 41 urges the suction block 11 in the direction of moving away from the plate 10, while heads 42 of each pin 39 serve and function as a stopper.

A movable suction block 12 is provided in front of the fixed suction block 11 and fixed at one end to a rod 43. The rod 43 is supported to a boss 45 which mounts to the plate 10 and passes therethrough in an air-tight manner so that the rod 43 is operable to allow the movable suction block 12 to approach or move away from the fixed suction block 11. Both suction blocks 11, 12 are hollow and each have a plurality of suction holes 46, 46, 47, 47 at their opposite surfaces, so that the bag 1 is attracted by the suction holes through the vacuum suction. The movable suction block 12 is provided with a plurality of elastic friction material elements 48 made of rubber which are buried in and project out of the face of block 12. Suction block 12 has suction holes 47 between the friction material elements 48.

To apply a vacuum to both of the suction blocks, the fixed suction block 11 is connected at one end with a port 49 (formed at a part of the boss 45) through a flexible tube 50, while the movable suction block 12 is connected to a tubular rod 43 with an elongate hole 51 formed at lateral face thereof, so that even when the rod 43 moves in a stroke, the movable suction block 12 can communicate with the port 49 through the elongate hole 51. With the port 49 is connected one end of a hose 57, so as to allow the suction block 12 to connect therethrough with a vacuum source.

As shown in FIGS. 1 and 2, a branching-off joint 54 for the vacuum hose is rotatably supported, through a pin 53, to a recess 52 formed centrally at the upper end of axle 27 arranged at the center of the packing apparatus. A main hose 55 is connected to the joint 54 at its upper end, and is also connected at the other end to a vacuum pump (not shown). Each of six primary hoses 56 is connected peripherally to the branching-off joint 54. The primary hoses 56 are each connected at their other ends to respective primary ports of automatic shut-off valves 2 fixed behind each plate 10. Each of the aforesaid secondary hoses 57 which are connected to secondary ports of the respective automatic shut-off valves 2 is connected to the suction blocks 11, 12 through the respective bosses 45.

Figure 6:
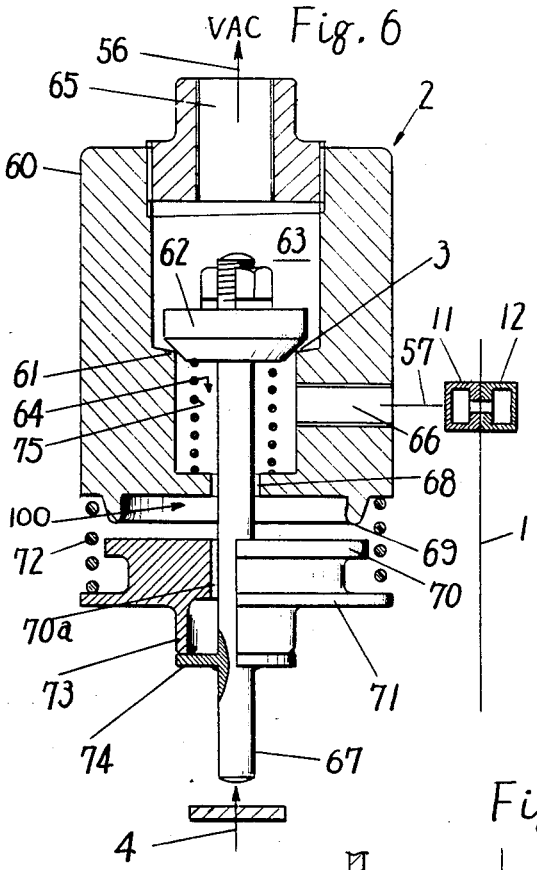
FIG. 6 is a longitudinal sectional view of valve 2 hown in FIG. 2.

The automatic shut-off valve 2 is constructed as shown in FIG. 6 and is adapted to be subjected to an outside operation force to thereby cut the suction produced at the suction blocks. Additionally, the valve 2 functions to automatically close any vacuum passage wherein air leakage would occur when any one of the six sets of suction blocks are subjected to air leakage, so that the valves can prevent a drop of suction at the other vacuum passages. In detail, the automatic shut-off valves 2, as shown, comprise a valve block 60 having therein a first valve seat 61 and a conical main valve 62 opposite thereto, the valve seat and main valve forming an on-off control portion 3. The valve block is provided with a primary chamber 63 and a secondary chamber 64 having therebetween the on-off control portion 3. The primary hose 56 attached to a port 65 formed at the primary chamber 63 is connected to the vacuum source, while a port 66 formed at the secondary chamber 64 is connected to the suction blocks 11, 12 through the secondary hose 57. The main valve 62 is provided at the conical face side with a valve rod 67 which extends through a bore 68 formed at the wall of the secondary chamber and which projects outwardly of the valve block. A self-holding valve 70 is fitted freely movably onto the valve rod 67 to be opposite to a second valve seat 69 formed at the outer face of the valve block. A main spring 72 is interposed between the valve block and a spring seat 71 formed at the self-holding valve 70, so that tension of the main spring 72 press-contacts a third valve seat 73 (formed at end face of the self-holding valve 70) with a plate valve 74 formed at the valve rod 67 and simultaneously closes the on-off control portion 3. An auxiliary spring 75 is fitted within the secondary chamber 64, so that tension of the auxiliary spring is applied to the main valve 62. The main spring 72 is made larger in tension than the auxiliary spring 75, thereby setting the main valve 62 to contact with the first valve seat 61 so as to allow the on-off control portion 3 to be normally closed.

Figure 7:
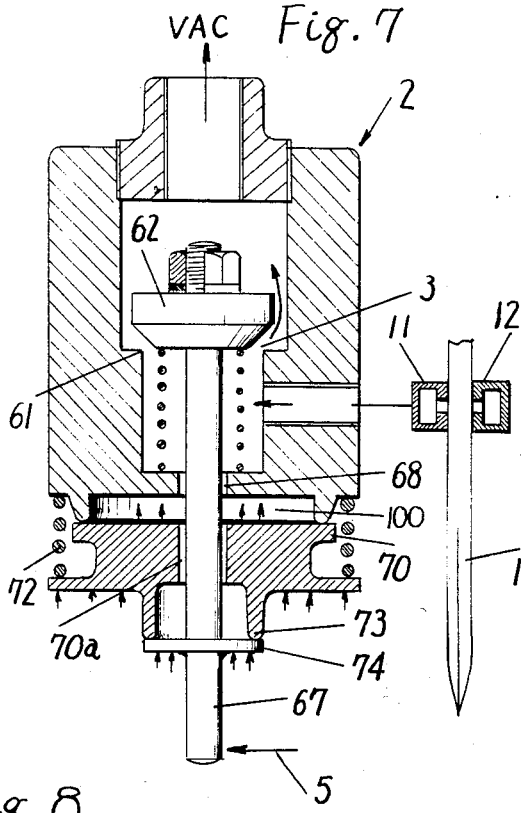
FIG. 7 is an explanatory view concerning the funcion of the valve 2.

Furthermore, the tension of main spring 72 is set to overcome a differential pressure applied to the main valve 62. In detail, the primary chamber 63 in FIG. 6 is always subjected to a vacuum suction. A resultant force consisting of a tension of the auxiliary spring 75 and a differential pressure existing relative to both sides of the main valve 62 functions to move the main valve 62 away from the first valve seat 61, but the main valve 62 is kept in close contact with the valve seat 61 because tension of main spring 72 against the function of the abovesaid resultant force is larger than the latter. Meanwhile, to open the vacuum passages, an outside operating force as shown by arrow 4 is applied to the valve rod 67 at its lower end. (In the FIG. 2 embodiment, an air cylinder 76 is provided on the base for applying an outside operating force to the automatic shut-off valve.) When the valve rod 67 is pushed through the outside operating force 4 while the main spring 72 is thereby contracted, the main valve 62 leaves the valve seat 61, as shown in FIG. 7, so that the suction blocks 11, 12 are subjected to a vacuum to thereby attract the bag 1. In this instance, the self-holding valve 70 and one side face of plate valve 74 are also subjected to vacuum suction through gaps 68, 70*a* around the valve rod 67. Since the self-holding valve 70 is formed larger in diameter than the main valve 62, a pilot chamber 100 is kept in subjection to a larger active force even after the outside operating force 4 to the valve rod is taken off, thereby keeping the main valve 62 away from the valve seat 61. However, when the valve block is subjected to an air leakage (for example, if air leakage occurs between the bag 1 and the suction blocks 11, 12), the self-holding valve 70 is subjected to a lessened differential pressure and the on-off control portion 3 is closed through tension of the main spring 72. In the case that there appears an air leakage between one set of the suction blocks and the bag, one corresponding vacuum passage is automatically closed to prevent a drop of vacuum suction at the other five vacuum passages. Alternatively, the on-off control portion 3 may be closed by laterally applying an outside operating force 5 to the valve rod 67 to tilt the same and allow the plate valve 74 to have a gap against the third valve seat 73, thereby resulting in an artificial air leakage at this gap so as to close the on-off control portion. In this instance, the bag 1 moves away from the suction blocks 11, 12 due to the weight of the bag itself. (In the FIG. 2 embodiment, the automatic shut-off valve in travelling contacts with an obstacle 77 (provided on the base 15) to thereby apply laterally an outside operating force to the valve rod.)

As shown in FIG. 1, the grooved cam plate 29 in a disc-like shape has a bent and curved groove 78 on the upper face. The groove 78 is designed to have a suitable 'ormation corresponding to the number of plates 10, i.e., ix plates in this case. It will be appreciated that the 'ormation of groove 78 may be arranged corresponding o variation of the number of the plates 10, for example, ight plates. The function of the groove 78 will be clari- ied later.

The six rods 43, as previously referred to, project at he back of each plate 10 and support at the end a fixed ectangular block 79 with a bore, and a rod-like shaped uide 80 fixed at the back of plate 10 is slidably engaged vith the bore of block 79, thereby preventing the rod 43 rom rotating.

Furthermore, small free wheels 81 are rotatably sup- orted to the lower faces to each block 79 to be engaged vith the groove 78.

Each chamber member *6a, 6b* is oppositely provided o the stopping positions D, E among those A, B, C, D, E, F at which the plates 10 stop. The chamber member *6a, 6b*, as shown in FIG. 2, comprise an elongate leg 82 vhich is pivotted at the lower end to the base 15 hrough a pin 83 and is connected with a grooved cam 84 (fixed to the driven shaft 31) through a link 85. The rooved cam 84 in its one rotation functions to pull the hambers *6a, 6b* toward the plate 10 through the pivot in 83, hold the chambers closely against the plate 10 in predetermined time, and therafter move the chambers way from the plate 10. When the driving shaft 24 ro- ates once, the driven shaft 31 also rotates once, so that vhen the main shaft 17 makes a rotation of one sixth, he driven shaft 31 rotates once. Thus, whenever the lates 10 move forward at one pitch, the chambers *6a, 6b* come to contact with the plates 10, and keep close ontact therewith to have an air-tight chamber therebe- ween during the stoppage of the plates 10.

Both chambers *6a, 6b* are connected with one end of espective hoses 86 to take out air within the chambers y means of a vacuum pump connected with the other nds of hoses 86.

A sealing bar 87 is formed in the latter chamber *6b* rranged secondarily in the rotation direction of the otor 20 to be operable by an actuator 88 provided utside of the chamber *6b*.

As shown in FIG. 5, each plate 10 is provided with a ealing block 89 above the fixed suction bar 11, and the ealing bar 87 is arranged to be opposite to the sealing lock 89 and is provided with a nichrome wire 90.

Figure 8:
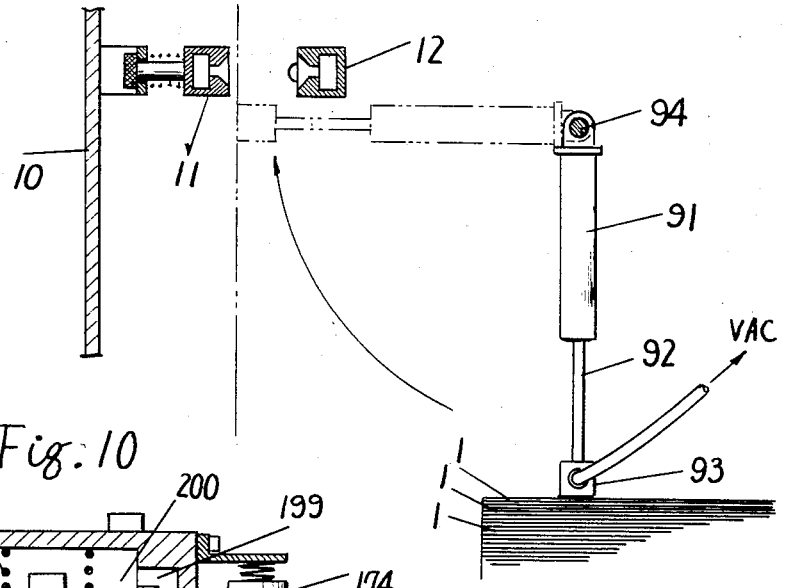
FIG. 8 is an explanatory view for a bag-feed device.

A bag-feed device shown in FIG. 8 is formed at the osition designated by reference A in FIG. 1. The bag- eed device comprises an air cylinder 91 having a piston od 92 and a suction bar 93 formed at the foremost end hereof. The air cylinder 91 is supported to a shaft 94 vhose rotation power allows the suction bar 93 to re- iprocate between the plate 10 and the arrangement osition of a number of piled bags 1, so that a bag 1 ttracted by the suction bar 93 is fed between the suc- ion blocks 11, 12 at the plate 10.

The packing apparatus is constructed as aforesaid. Next, operation of the apparatus will be detailed. In IG. 2, the pin 26 at the driving shaft 24 in continuous otation periodically kicks the Geneva gear 23, so that he main shaft 17 and rotor 20 rotate at an angle of 60 legrees in every constant time interval, so that the bag- upport elements consisting of the suction blocks 11, 12 re conveyed along an endless path at the same pitch as hat of the set intervals between each bag-support ele- nents. Simultaneously, the axle 27 repeats normal rota- ion and reverse rotation within the angle range of 60 degrees due to the cam 32 at the driven shaft 31 in an associated movement with the driving shaft 24.

In detail, the rotor 20 and the grooved cam 29 integrally formed with the axle 27 simultaneously start to rotate in the same direction at an angle of 60 degrees, then, the grooved cam 29 reversely rotates at an angle of 60 degrees to return to the original position during the stoppage of the rotor 20. FIG. 1 shows the situation immediately after the stoppage of the rotor 20 and grooved cam 29 after they had simultaneously started to have rotated clockwise at an angle of 60 degrees. In this instance, the bag 1 is immediately fed between the suction blocks 11, 12 at the aforesaid section A. Specifically, the suction bar 93 attracts as shown in FIG. 8 a top one of the piled bags 1 and feeds it between the suction blocks 11, 12 from their lower side due to rotation of the shaft 94. In such instance, the cam 32 is in the condition shown in FIG. 3 wherein the bell crank 34 contacts with the cam 32 at its shortest radius portion and is extremely shifted in the clockwise direction. The cam 32, then, rotates in the direction at the arrow to cause the driven shaft 17 to start its reverse rotation, i.e., rotation in counterclockwise direction, and also causing the grooved cam 29 in the condition shown in FIG. 1 to start its reverse rotation, i.e., rotation in the counterclockwise direction.

The groove 78 is arranged to be most extremely twisted at the section A shown in FIG. 1, so that when the small freewheel 81 is guided through this twisted part of groove 78, the movable suction block 12 at the section A contacts with the fixed suction block 11 to support therebetween the mouth of bag 1. Immediately thereafter the air cylinder 76 shown in FIG. 2 applies an outside operating force to the automatic shut-off valve 2. As already referred to according to FIGS. 6 and 7, when the valve 2 is subjected to an outside operating force 4, the vacuum is applied to the opposite suction blocks 11, 12 to thereby allow them to attract the bag.

As understood from the form of groove 78 from the section A to section B, the movable suction block 12 moves away from the fixed suction block 11 due to a continued rotation of the grooved cam 29, thereby opening the mouth of bag 1 attracted by the suction blocks. The groove 78 is formed to be parallel to the periphery of grooved cam 29 with respect to the sections B and C, so that when the grooved cam 29 reversely rotates, the mouth of bag 1 at the section B is kept to be open. The object is filled within the bag through the opening portion by means of a predetermined means at this section B.

Furthermore, the groove 78 extends near the center of cam 29 with respect to the sections C and D, so that the movable suction block 12 is moved toward the fixed suction block 11 at the section C due to the reverse rotation of grooved cam 29.

The groove 78 is arranged to be just a small circular arc with respect to the sections D through F, so that the bags 1 are kept sandwitched by the suction blocks at each of sections D and E even upon the reverse rotation of the grooved cam 29. At these sections D and E, the two chambers *6a, 6b* each contacts with the plates 10 to form an air-tight room around the bags, while starting to discharge air around the bags by means of the hoses 86. The discharging of air is continued until an instant immediately before rotor 20 and grooved cam 29 restart to rotate clockwise after a certain time interval from cessation of reverse rotation of the grooved cam 29. When the magnitude of the vacuum within the vacuum chamber 6a rises in this process, a differential pressure between the inside and outside of the suction blocks 11, 12 in the chamber 6a decreases and the suction blocks finally come to have no power of attracting the bag. However, the elastic friction materials 48 contacting with the face of bag 1 as shown in FIGS. 4 and 5 prevent the bag from sliding down, and a stress of the spring 41 is applied to the bag, so that the bag can be supported and kept in suspension even after the differential pressure supporting force for the bag has vanished.

A plurality of elastic friction materials 48 shown in FIG. 5 engage and support the bag 1 at a plurality of points therebetween, so that the mouth of the supported bag 1 partially has opening portions throught which air in the bag is discharged. With the rise of magnitude of vacuum inside the bag, numerous bubbles rise up in the liquid, which being filled up together with the chopped-up pickles within the bag, in such a manner of weaving their way through the pickles. But, some bubbles are restrained from rising up by the obstacles, i.e., the pickles, and remain in the bag. The vacuum inside the vacuum chamber is restrained before the abovesaid liquid comes to be at its boiling point, and air is introduced into the vacuum chamber 6a, thereby applying an impact to the bag so as to agitate the pickles in the bag, resulting in freeing of the bubbles restrained by the pickles.

Then, the two vacuum chambers 6a, 6b are disengaged from the plates 10, and the rotor 20 and grooved cam 29 rotate again clockwise to convey and move each of the six plates 10 at one pitch respectively. Accordingly, the bag 1 placed at the first vacuum chamber 6a is moved to the second chamber 6b and again subjected thereat to the vacuum so as to expel any residual air from the bag. Finally, the sealing bar 87 is pushed forward by the actuator 88 to heat, melt and seal the mouth of the bag between the sealing bar and the sealing block 89. As a matter of time convenience, the mouth of the bag may be simply and softly sealed at the section E and substantially sealed at the later section F which may be provided with a different sealing bar.

The obstacle 77 shown in FIG. 2 is set at a predetermined position, so that when the rotor 20 rotates to allow the automatic shut-off valve 2 to contact with the obstacle 77, an outside operating force 5 is thereby applied to the valve rod 67 as shown in FIG. 7. As already referred to, when the outside operating force 5 is applied to the valve rod 67, a gap is formed between the plate valve 74 and the third valve seat 73, so that air passes through the gap and flows into the valve 2, thereby immediately closing the on-off control portion 3 due to tension of main spring 72 as shown in FIG. 6. This results in the bag being disengaged from the suction block 12 at the section F.

The automatic shut-off valve 2 functions to automatically close when the differential pressure vanishes as aforesaid, so that even if air is sucked between any one set of suction blocks and one corresponding bag to flow into one corresponding vacuum passage (this may occur when the bag is distorted), the vacuum passage is immediately closed to thereby previously prevent any influence on the other vacuum passages.

Figure 9:
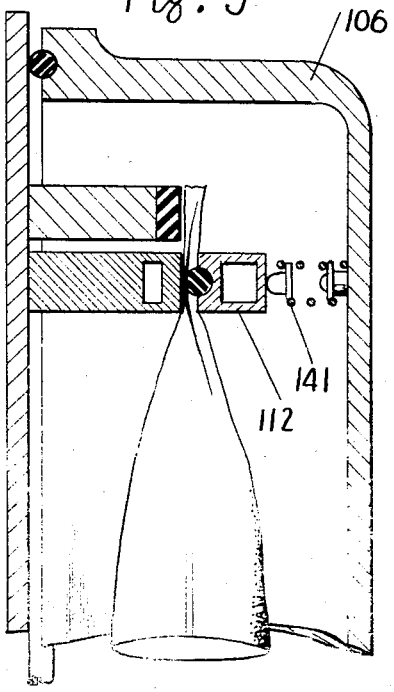
FIG. 9 shows a modified embodiment of a bag-supıort means.

Means for applying a spring force to the bag through the suction block may be constructed as shown in the FIG. 9 embodiment, wherein a spring 141 is provided between the movable suction block 112 and a chamber 106, while the spring 41 is interposed between the plate 10 and the fixed suction block 11 in the FIG. 4 Embodiment.

Figure 10:
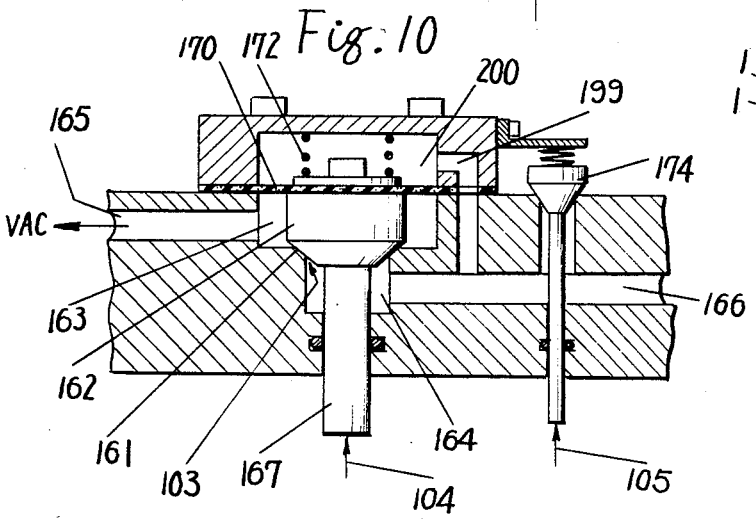
FIG. 10 shows a modified embodiment of an automatic shut-off valve.

In the FIG. 6 embodiment, the self-holding valve 70 is provided other than the main valve 62, while FIG. 10 shows an embodiment using an automatic shut-off valve wherein a main valve 162 is coupled with a diaphragm 170. In this embodiment, a primary chamber 163 and a secondary chamber 164 have therebetween a valve seat 161. The primary chamber 163 is connected with the vacuum source through a passage 165, and the secondary chamber 164 is connected with the suction blocks through a passage 166. The diaphragm 170 define a pilot chamber 200 above the primary chamber 163. The secondary chamber 164 is connected with the pilot chamber 200 through a pilot passage 199, and a valve 174 for introducing air is formed at a secondary passage 166. As shown, a spring 172 set within the pilot chamber 200 usually urges the main valve 162 against the valve seat 161. When an outside operating force 104 is applied to the lower end of a valve rod 167 to open an on-off control portion 103, a vacuum in the primary passage 165 works also on the pilot chamber 200 through the secondary passage 166 and pilot passage 199. (The foremost end of the secondary passage 166 is to be closed by the bag in this case.) Thus, even when the outside operating force 104 is off, the on-off control portion 103 is kept open due to the self-holding function since atomospheric pressure is applied to the lower end face of the valve rod 167. Then, the bag is disengaged to allow air to flow into the secondary passage 166, or the valve 174 is pushed up through the outside operating force 105 to intentionally cause air to flow into the secondary passage 166, so that the on-off control portion 103 can be automatically closed.

Although a specific form of the invention has been described and shown in the application, it will be apparent that various changes and improvements may be made in the arrangement of parts which would come within the scope of the following claims.

What is claimed is:

1. A rotary packing apparatus comprising:

a plurality of bag-support elements disposed peripherally at a constant pitch along a substantially circular endless path, said bag-support elements for supporting flexible bags in suspension, such that openings in said bags are oriented upwardly;

a conveying means for intermittently conveying said bag-support elements along said path at a same pitch as said pitch of said bag-support elements, said bag support elements respectively comprising plates supported by said conveying means;

a bag-feed means for intermittenly feeding said bags to the bag-support elements adjacent to said conveying means;

a filling means for filling objects into said bags through said openings;

a sealing means for sealing said opening portions of said bags;

a vacuum pump;

a first chamber member and a second chamber member each disposed outside and adjacent to said path, said first chamber member being disposed between said filling means and said sealing means, said second chamber member being disposed at said sealing means, said first chamber member and said second chamber each being disposed at a position at which said bag-support elements are stopped intermittently by said conveying means, said first and second chamber members being disposed opposite to a pair of said plates supported by said conveying means when said bag-support elements are stopped intermittently;

means for moving said first and second chamber members to contact said pair of plates to form first and second vacuum chambers therewith and for moving said first and second chamber members away from said pair of plates to open said first and second vacuum chambers to atmosphere, said first and second vacuum chambers being in fluid communication with said vacuum pump for creating a vacuum in said bags; and means cooperating with said vacuum pump for (i) subjecting said bags supported by said bag-support elements to a first vacuum inside said first vacuum chamber disposed in an initial position relative to a direction in which said bag-support elements are conveyed, (ii) subsequently opening said first vacuum chamber to atmosphere, and (iii) thereafter subjecting said bags to a second vacuum inside said second vacuum chamber provided behind said first vacuum chamber relative to said direction in which said bag-support elements are conveyed.

2. A rotary packing apparatus according to claim 1, wherein each said bag-support element comprises a pair of suction blocks having suction holes communicating with said vacuum pump, at least one of said blocks having at a surface thereof an elastic friction material for contacting a said bag, and at least one of said blocks having a spring for urging one of said blocks toward the other block to sandwich and support a said bag between said blocks in cooperation with said elastic friction material.

3. A rotary packing apparatus according to claim 2, wherein said suction blocks comprise a fixed suction block and a movable suction block toward and away from said fixed suction bloc, said fixed suction block being elastically supported to a said plate of its associated bag-support element supported to said conveying means by means of said spring.

4. A rotary packing apparatus according to claim 2, further comprising a passage connecting said vacuum pump with said suction holes at each said suction block, said passage comprising an automatic shut-off valve for shutting-off communication of said suction holes at said suction blocks with said vacuum pump when said suction holes are open to atmosphere.

5. A rotary packing apparatus according to claim 4, wherein said automatic shut-off valve comprises:

(a) a main valve for opening and closing a primary chamber communicating with said vacuum pump and a secondary chamber communicating with said suction holes at said suction blocks, (b) a spring urging said main valve in a closing direction, (c) an opening means for opening said main valve against said spring, (d) a self-holding means for self-holding the opening of said main valve when opened by said opening means, and (e) a releasing means for connecting said secondary chamber with atmosphere, releasing the holding of opening of said main valve through said self-holding means, and closing said main valve.

* * * * *